United States Patent [19]

Maenaka

[11] Patent Number: 4,739,942

[45] Date of Patent: Apr. 26, 1988

[54] WEFT YARN STORING DEVICE

[75] Inventor: Koyu Maenaka, Matsuto, Japan

[73] Assignee: Tsudakoma Corp., Kanazawa, Japan

[21] Appl. No.: 100,240

[22] Filed: Sep. 23, 1987

[30] Foreign Application Priority Data

Sep. 26, 1986 [JP] Japan ..... 61-147479[U]

[51] Int. Cl.[4] ..... B65H 51/20; D03D 47/36

[52] U.S. Cl. ..... 242/47.01; 139/452

[58] Field of Search ..... 242/47.01, 47.02, 47.03, 242/47.04, 47.05, 47.06, 47.07, 47.08, 47.09, 47.1, 47.11, 47.12, 47.13, 47; 139/452; 66/132 R; 226/43, 42, 24

[56] References Cited

U.S. PATENT DOCUMENTS

| | | | |
|---|---|---|---|
| 4,132,368 | 1/1979 | Schiess et al. | 242/47.01 |
| 4,226,379 | 10/1980 | Brouwer et al. | 242/47.01 |
| 4,368,854 | 1/1983 | Valois | 242/47.01 |
| 4,452,402 | 6/1984 | Ghiardo | 242/47.01 |
| 4,530,381 | 7/1985 | Takegawa | 242/47.01 X |
| 4,541,462 | 9/1985 | Tholander | 242/47.01 X |
| 4,550,754 | 11/1985 | Iida | 242/47.01 X |
| 4,586,543 | 5/1986 | Volland et al. | 242/47.01 X |
| 4,651,786 | 3/1987 | Griffith | 242/47.01 X |

*Primary Examiner*—Stanley N. Gilreath

*Attorney, Agent, or Firm*—Wenderoth, Lind & Ponack

[57] ABSTRACT

A weft yarn storing device having a rotary yarn guide for winding a weft yarn on a measuring and storing drum, a motor for driving said rotary yarn guide for rotation, which comprises a controller. The controller comprises a frequency pattern generator which generates, upon the reception of a start signal, a control frequency signal of a control frequency pattern having a creep of a low frequency in a deceleration period in which the motor is decelerated; a voltage pattern generator which generates a control voltage signal corresponding to the frequency of the control frequency signal; a pulse width modulating unit which generates a pulse width modulated signal on the basis of the control frequency signal and the control voltage signal; and a driver which applies a DC voltage intermittently to the motor according to the output signal of the PWM unit.

2 Claims, 2 Drawing Sheets

WEFT YARN STORING DEVICE

BACKGROUND OF THE INVENTION

1. Field of the Invention

The present invention relates to a weft storing device for looms and, more specifically, to a weft yarn storing device having a control unit for controlling the operation of a motor for driving the mechanical instrumentalities of the weft yarn storing device so as to prevent the free rotation and reverse rotation of the output shaft of the motor in stopping the same.

2. Description of the Prior Art:

The weft yarn storing device has a rotary yarn guide which rotates to pull out a weft yarn from a yarn package by a length necessary for one picking cycle and to wind the weft yarn around a stationary measuring and storing drum in successive loops. The weft yarn thus measured and wound on the measuring and storing drum is held on the measuring and storage drum with a holding pin, which is retracted to release the weft yarn for picking in timed relation with the picking motion of the loom. When the holding pin is retracted to release the weft yarn from the measuring and storing drum, a picking nozzle jets a pressurized picking fluid into a shed of a wrap yarn to pick the measured length of the weft yarn.

The rotary yarn guide is rotated by a motor, which is started and stopped at a high response speed to wind the required length of weft yarn on the measuring and storing drum in a very short time. Accordingly, an induction motor is employed as the motor for driving the rotary yarn guide, and the operating speed of the motor is controlled through voltage-to-frequency (hereinafter abbreviated to "V/F") conversion. The motor is decelerated through a DC dynamic braking system for the following reasons. That is, a DC dynamic braking system, namely, an electrical braking system, entails little mechanical abrasion, is capable of producing a large torque in low rotation speed zone as compared with other electrical braking systems, comprises less components than other electrical braking systems without requiring conductors and capactitors, and DC power is available on the loom because the loom is provided with an inverter for controlling the operating speed of the motor.

However, when DC dynamic brake is applied to stop an induction motor which is controlled through V/F conversion, it is possible, depending on the stopping phase of the rotor of the induction motor, that the rotor is caused to recoil by a reverse torque produced therein by interaction between the braking magnetic field and the permanent magnetic flux of the rotor. If the rotor of the motor for driving the rotary yarn guide is recoiled, a portion of the weft yarn extending from the rotary yarn guide to the circumference of the measuring and storing drum is slackened to reduce the winding tension of the weft yarn in the initial stage of the next weft yarn measuring and storing cycle. Consequently, it is possible that the succeeding loops of the weft yarn are wound over the preceding loops of the weft yarn in the next weft yarn measuring and storing cycle forming overlapping winds, which affects adversely to the unwinding of the weft yarn from the measuring and storing drum and to the picking operation.

Furthermore, in some cases, when the motor for driving the rotary yarn guide is stopped instantaneously during high acceleration, the rotor of the motor runs free by several turns due to step-out to wind the weft yarn on the measuring and storing drum by an excessive length.

SUMMARY OF THE INVENTION

Accordingly, it is a principal object of the present invention to provide a weft yarn storing device equipped with a control unit capable of preventing a motor for driving the rotary yarn guide thereof from recoiling and running free in stopping the motor.

According to the present invention, the output frequency control pattern for controlling the output frequency of a frequency pattern generator for controlling driving current supplied to the motor for driving the rotary yarn guide is set so as to diminish the output frequency of the frequency pattern generator gradually to a sufficiently low level in decelerating the motor, to maintain the output frequency at the sufficiently low level for fixed creep, and then to cut off the output of the frequency pattern generator. Thus, the motor is braked smoothly without causing the rotor to recoil and run free, so that overlapping winds are never formed on the measuring and storing drum.

DESCRIPTION OF THE PREFERRED EMBODIMENT

Figure 1:
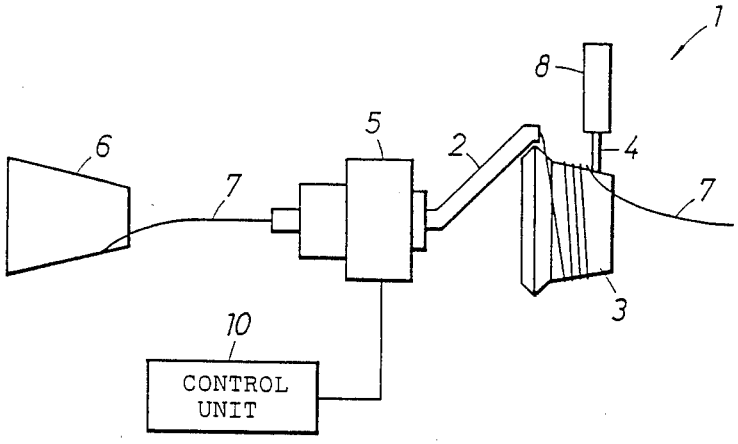
FIG. 1 is a schematic illustration of a weft yarn storing device incorporating the present invention.

Referring to FIG. 1, a weft yarn storing device 1 comprises mechanical instrumentalities such as a rotary yarn guide 2, a stationary measuring and storing drum 3, a holding pin 4, a motor 5 for rotating the rotary yarn guide 2, and a solenoid actuator 8 for operating the holding pin 4.

The motor 5 rotates the rotary yarn guide 2 to pull out a weft yarn from a yarn package 6 and to wind the weft yarn 7 around the measuring and storing drum 3 in successive loops. The solenoid actuator 8 operates the holding pin 4 so as to engage the circumference of the measuring and storing drum 3 to hold the loops of the weft yarn 7 on the measuring and storing drum 3. In picking the weft yarn 7 wound on the measuring and storing drum 3 by a picking nozzle, not shown, the solenoid actuator 8 retracts the holding pin 4 from the circumference of the measuring and storing drum 3 to release the weft yarn 7. The motor 5 is an induction motor which is subject to the V/F open loop control of a control unit 10 according to the present invention.

Figure 2:
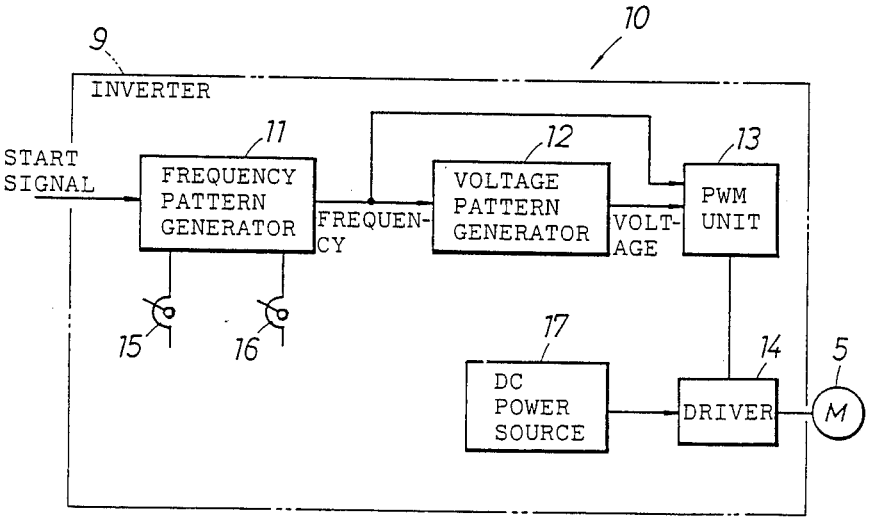
FIG. 2 is a block diagram showing the circuit constitution of a control unit, in a preferred embodiment, according to the present invention.

Referring to FIG. 2, the control unit 10 comprises an inverter 9 comprising a frequency pattern generator 11 which generates a control frequency signal of a frequency in response to a start signal given thereto from a main controller, not shown, a voltage pattern generator 12 which generates a control voltage signal corresponding to the control frequency signal, a pulse width modulating unit (hereinafter abbreviated to "PWM unit") 13 which generates a pulse width modulating signal corresponding to the control frequency signal and the control voltage signal, and a driver 14 which controls driving current for driving the motor 5 according to a control signal provided by the PWM unit 13.

Figure 3:
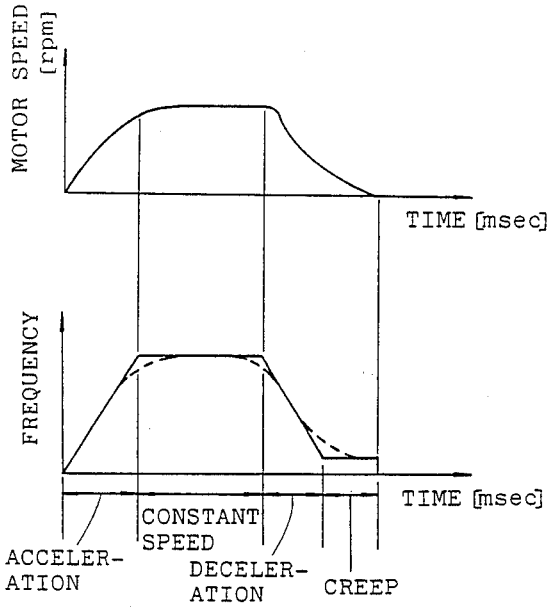
FIG. 3 is a graph showing a frequency control pattern and corresponding variation of the rotating speed of a motor for driving the rotary yarn guide of the weft yarn storing device with time.
Figure 4:
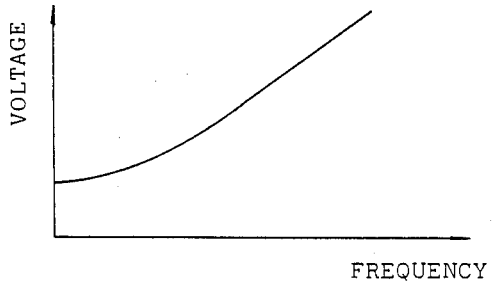
FIG. 4 is a graph showing the variation of voltage with frequency.

Upon the reception of the start signal, the frequency pattern generator 11 generates a control frequency signal of a control pattern as shown in FIG. 3 on the basis of data set by an acceleration time setting device 15 and a deceleration time setting device 16. The duration of the maximum frequency in the control frequency pattern corresponds to a period in which the motor rotates at a fixed rotating speed, and is proportional to the magnitude of the start signal. The control frequency pattern consists of an acceleration period, a constant speed period, a deceleration period, and a creep in which frequency is maintained at a low level after deceleration. The output of the frequency pattern generator 11 is cut off at the end of the creep. Naturally, the frequency control pattern need not be defined by a polygonal line having points of inflection, but may be defined by a smooth curve as indicated by broken lines in FIG. 3. The control frequency signal is applied to the PWM unit 13 and the voltage pattern generator 12. Upon the reception of the control frequency signal, the voltage pattern generator 12 generates a control voltage signal on the basis of a control voltage pattern as shown in FIG. 4 to control the motor 5 in a fixed torque characteristic and gives the control voltage signal to the PWM unit 13. Then, the PWM unit 13 generates a pulse signal according to the control frequency signal and the control voltage signal, and then feeds the pulse width modulating signal to the driver 14. Then, the driver 14 applies a DC voltage generated by a DC power source 17 intermittently according to the pulse signal to the motor 5. Consequently, the motor 5 rotates the rotary yarn guide 2 according to the control frequency pattern.

Satisfactory motor stopping characteristics were obtained through experiments, in which a high-response motor having an acceleration characteristic of 0-to-3000 rpm/200 msec and a deceleration characteristic of 3000-to-0 rpm/200 msec employed as the motor 5 was controlled by the controller 10 according to a frequency control pattern having a creep frequency of 3 Hz and a creep of 100 msec.

When the application of the driving voltage to the motor 5 is stopped at the end of a creep on the order of 150 msec, the motor 5 stops naturally without being braked after rotating free by a quarter of turn or less after the stoppage of voltage application. However, the free rotation of a quarter of a turn or less is negligible and does not cause any trouble. Although the motor 5 rotates during the creep, when the creep frequency is a sufficiently small frequency of, for example, 3 Hz or below, the number of rotation during the creep is as small as half a turn, which is insignificant. Preferably, the creep is in the range of 100 to 200 msec and the creep frequency is in the range of 2 to 4 Hz in this embodiment of the present invention.

The frequency pattern generator 11 and the voltage pattern generator 12 may be analog function generators, or digital function generators such as microcomputers.

What is claimed is:

1. A weft yarn storing device having a rotary yarn guide for winding a weft yarn on a measuring and storing drum, a motor for driving said rotary yarn guide for rotation, which comprises a controller comprising:

a frequency pattern generator which generates, upon the reception of a start signal, a control frequency signal of a control frequency pattern having a creep of a low frequency in a deceleration period in which said motor is decelerated;

a voltage pattern generator which generates a control voltage signal corresponding to the frequency of the control frequency signal;

a pulse width modulating unit which generates a pulse width modulated signal on the basis of the control frequency signal and the control voltage signal; and a driver which applies a DC voltage intermittently to said motor according to the output signal of said pulse width moduling unit.

2. A weft yarn storing device according to claim 1, wherein said frequency pattern generator is provided with an acceleration time setting device and a deceleration time setting device.

* * * * *